US009500448B1

(12) United States Patent
Nance et al.

(10) Patent No.: US 9,500,448 B1
(45) Date of Patent: Nov. 22, 2016

(54) BURSTING SWITCH

(71) Applicants: Christopher J. Nance, Middletown, CA (US); Bradley L. Hanna, King George, VA (US); Edwin J. Wild, Niceville, FL (US)

(72) Inventors: Christopher J. Nance, Middletown, CA (US); Bradley L. Hanna, King George, VA (US); Edwin J. Wild, Niceville, FL (US)

(73) Assignee: Reynolds Systems, Inc., Middletown, CA (US)

( * ) Notice: Subject to any disclaimer, the term of this patent is extended or adjusted under 35 U.S.C. 154(b) by 0 days.

(21) Appl. No.: 14/733,981

(22) Filed: Jun. 9, 2015

(51) Int. Cl.
*F42B 3/12* (2006.01)

(52) U.S. Cl.
CPC ..... *F42B 3/124* (2013.01); *F42B 3/125* (2013.01); *F42B 3/12* (2013.01)

(58) Field of Classification Search
CPC ..... F42B 3/124; F42B 3/12; F42B 3/18; F42B 3/121; F42B 3/122; F42B 3/125; F42B 3/127; F42B 3/128; F42B 3/13
USPC ..... 102/202.7, 202.5, 202.9, 202.14, 202.8
See application file for complete search history.

(56) References Cited

U.S. PATENT DOCUMENTS

| | | | | |
|---|---|---|---|---|
| 7,571,679 | B2 * | 8/2009 | Nance | F42B 3/13 102/202.14 |
| 7,866,264 | B2 * | 1/2011 | Nance | F42B 3/103 102/202.14 |
| 8,113,117 | B2 * | 2/2012 | Nance | F42B 3/103 102/202.14 |
| 2004/0107856 | A1 * | 6/2004 | Hennings | F42B 3/127 102/202.7 |
| 2008/0134921 | A1 * | 6/2008 | Nance | F42B 3/13 102/202.5 |
| 2009/0266260 | A1 * | 10/2009 | Nance | F42B 3/13 102/202.7 |
| 2011/0072997 | A1 * | 3/2011 | Nance | F42B 3/103 102/202.7 |

* cited by examiner

*Primary Examiner* — Michael David
(74) *Attorney, Agent, or Firm* — Harness, Dickey & Pierce, P.L.C.

(57) ABSTRACT

An initiator assembly having a base, first and second conductive elements, a first electrically insulating member and an energetic material. The first conductive element, which is configured to receive an electrical input, is coupled to the base and includes a tip. The first electrically insulating member is disposed over the tip. The second conductive element has a bridge that is disposed over the first electrically insulating member. The bridge is configured to vaporize in response to transmission of the electrical input from the tip of the first conductive element to the bridge. The energetic material is disposed over the bridge. Energy produced during vaporization of the bridge is transmitted to the energetic material to initiate at least one of a combustion event, a deflagration event and a detonation event in the energetic material. A method for operating an initiator assembly is also provided.

19 Claims, 7 Drawing Sheets

BURSTING SWITCH

FIELD

The present disclosure relates to a bursting switch.

BACKGROUND

This section provides background information related to the present disclosure which is not necessarily prior art.

Exploding foil initiators, and more specifically the low energy exploding foil initiators (LEEFI's) pioneered by Reynolds Systems, Incorporated of Middletown, Calif., represent an evolutionary step in the design of igniters and detonators due to their improved reliability and safety. It is desirable in some instances to include switch capabilities with a LEEFI to provide further enhancements in safety. Heretofore, such switch capabilities have been provided either with a stand-alone switch device or a switch device that is integrated into the LEEFI in the manner shown in U.S. Pat. No. 6,851,370 and 873,122.

The use of a stand-alone switch device is not typically desirable as such devices tend to be relatively costly and more importantly, because such devices are typically difficult to package into the device that is to be ignited or detonated. The devices detailed in the '370 and '122 patents are somewhat less costly, but can significantly increase the space (area) that is needed to package the LEEFI into the device that is to be ignited or detonated. In some instances, it is simply not possible to increase the size of the "foot print" of the LEEFI to incorporate the switching capabilities that are described in the '370 and '122 patents. Accordingly, there remains a need in the art for an improved LEEFI having integrated switch capabilities.

SUMMARY

This section provides a general summary of the disclosure, and is not a comprehensive disclosure of its full scope or all of its features.

In one form, the present disclosure provides an initiator assembly with a base, a first contact coupled to the base, a first electrically insulating member, a bridge, a flyer layer and a barrel. The first contact defines a first switch element. The first electrically insulating member is disposed over the first switch element such that the first switch element is disposed along an axis between the base and the first electrically insulating member. The bridge is coupled to the first electrically insulating member such that the first electrically insulating member is disposed along the axis between the first switch element and the bridge. The flyer layer is coupled to the bridge. The barrel is coupled to the base and is disposed over the bridge and at least a portion of the flyer layer. The barrel is disposed along the axis.

In another form, the present disclosure provides a method that includes: providing an initiator assembly having a first switch element, a bridge, a flyer layer and a barrel, the first switch element and the bridge being spaced vertically apart along an axis, the flyer layer overlying the bridge, the barrel defining a barrel aperture and being disposed over at least a portion of the flyer layer; and applying electrical power to the first switch element to vaporize the bridge, wherein vaporization of the bridge causes a portion of the flyer layer within the barrel aperture to be expelled from the barrel.

In still another form, the present disclosure provides an initiator assembly that includes a base, a first conductive element coupled to the base, a first electrically insulating member, a second conductive element and an energetic material. The first conductive element includes a tip and is configured to receive an electrical input. The first electrically insulating member is disposed over the tip. The second conductive element has a bridge that is disposed over the first electrically insulating member. The bridge is configured to vaporize in response to transmission of the electrical input from the tip of the first conductive element to the bridge. The energetic material is disposed over the bridge. Energy produced during vaporization of the bridge is transmitted to the energetic material to initiate at least one of a combustion event, a deflagration event and a detonation event in the energetic material.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
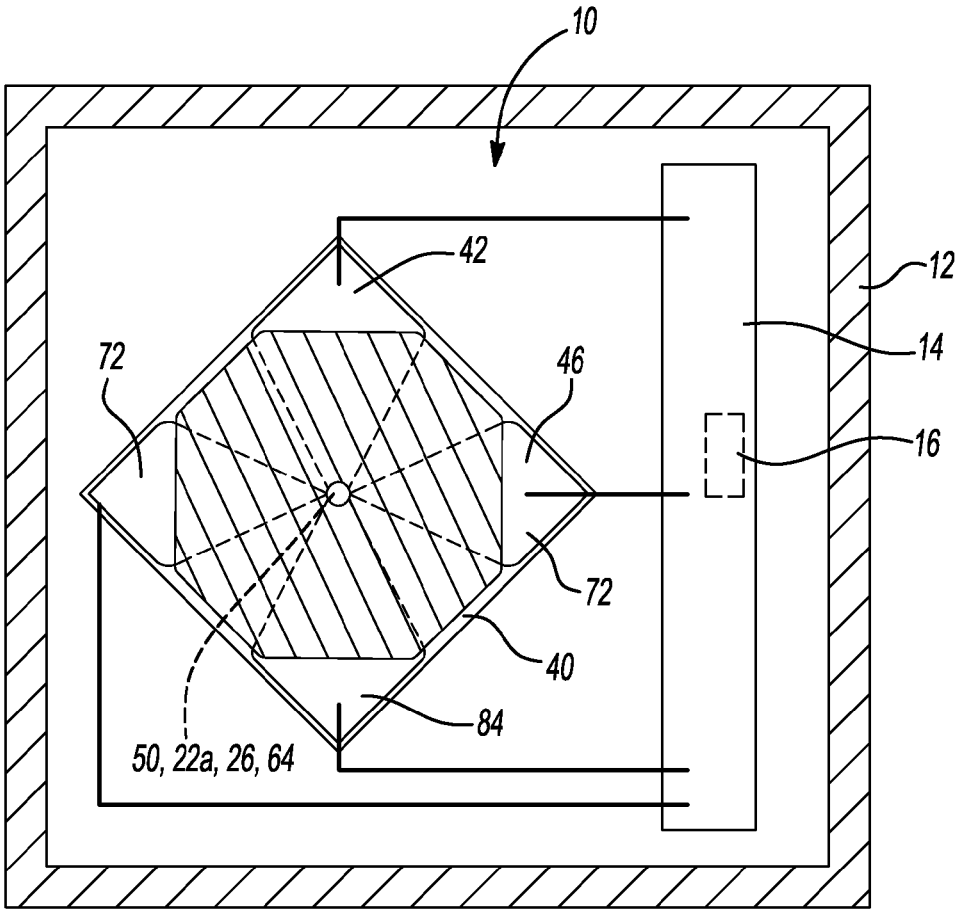
FIG. 1 is a schematic illustration of an initiator assembly constructed in accordance with the teachings of the present disclosure in operative association with an electronic safe-and-arm device.

With reference to FIG. 1 of the drawings, an initiator assembly constructed in accordance with the teachings of the present disclosure is generally indicated by reference numeral 10. The initiator assembly 10 is illustrated as being housed in a housing 12 and in operative association with a conventional safe-and-arm device 14 that is used to selectively couple the initiator assembly 10 to a source of electrical power 16.

Figure 2:
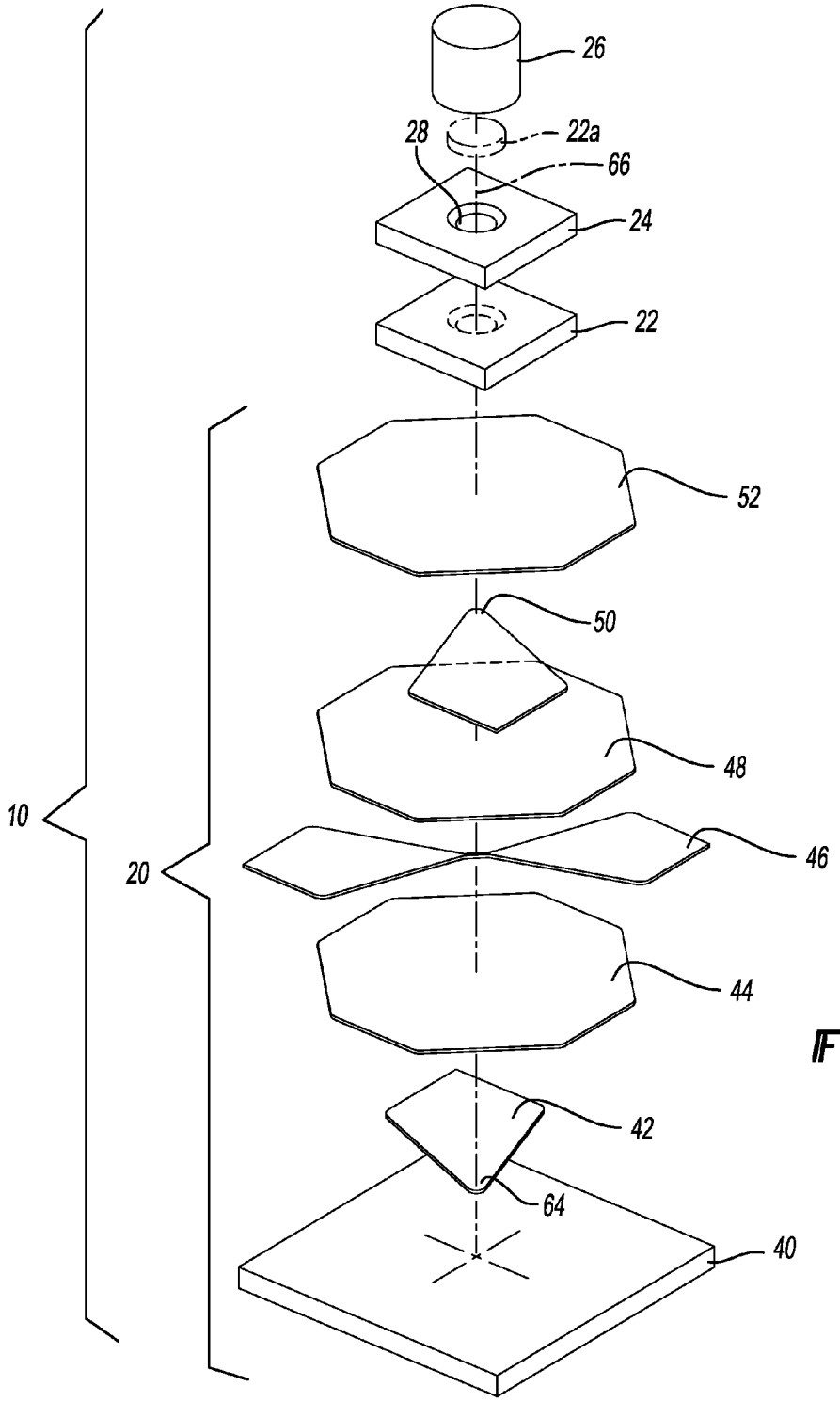
FIG. 2 is an exploded perspective view of a portion of the initiator assembly of FIG. 1.

With reference to FIG. 2, the initiator assembly 10 can include an initiator device 20, a flyer layer 22, a barrel 24 and an input charge 26. In the particular example provided, the initiator assembly 10 is similar to a low energy exploding foil initiator (LEEFI) in that when the initiator assembly 10 is operated, a portion of the initiator device 20 is vaporized and causes a portion of the flyer layer 22 (i.e., the flyer 22*a* that is illustrated in phantom line) to be sheared from a remaining portion of the flyer layer 22 and travel through a barrel aperture 28 in the barrel 24 where it impacts another structure, such as the input charge 26, to initiate a wavefront that travels through the input charge 26 to cause an intended reaction, such as detonation.

The initiator device 20 can include a base 40, a first contact 42, a first electrically insulating member 44, a trigger switch 46, a second electrically insulating member 48, a second bridge element 50 and a third electrically insulating member 52. The base 40 can be formed from an electrically insulating material, such as ceramic, glass, polyimide, or silicon and can define a planar surface 60.

Figure 3:
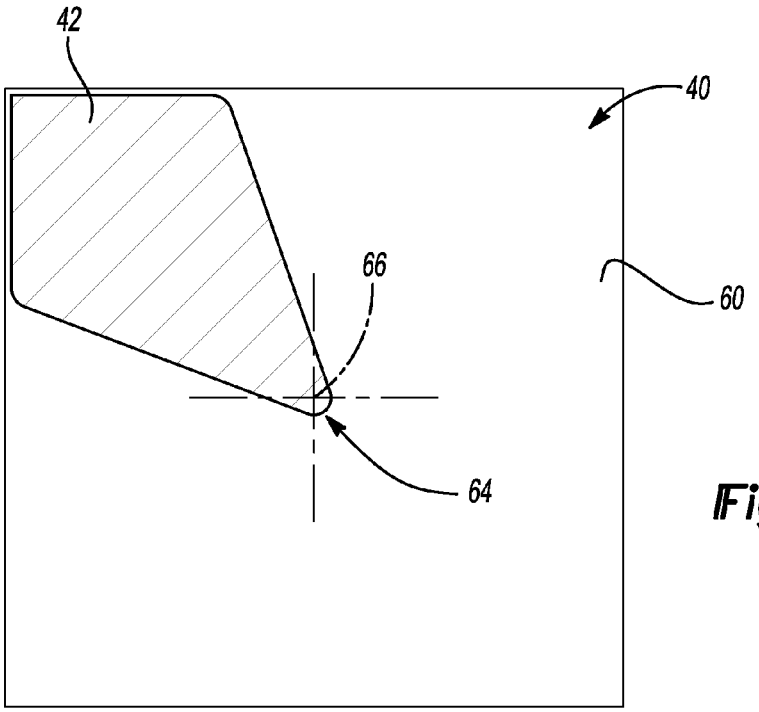
FIG. 3 is a top plan view of a portion of the initiator assembly depicting a portion of a manufacturing process where a first switch contact is coupled to a base.

With reference to FIG. 3, the first contact 42 can be formed from one or more suitable electrically conductive materials, such as nickel, copper, gold, silver and alloys thereof, and can be fixedly coupled to the planar surface 60 of the base 40 in an appropriate manner, such as by vapor deposition. The first contact 42 can define a first bridge element 64 that can be disposed along an axis 66 that can be perpendicular to the planar surface 60. In the particular example provided, the first bridge element 64 has a tip with a semi-circular shape that is defined by a radius.

Figure 4:
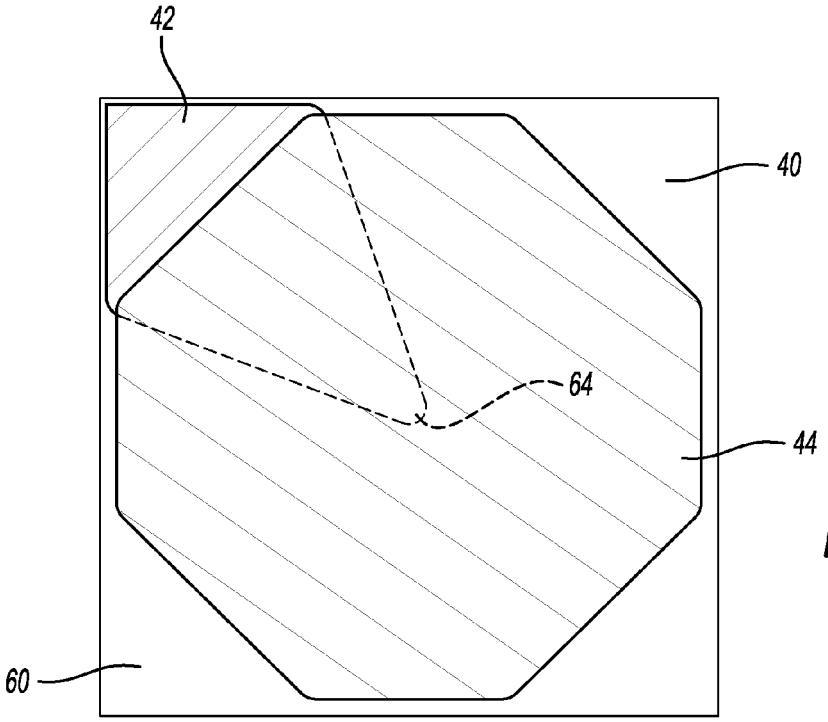
FIG. 4 is a top plan view of a portion of the initiator assembly depicting a portion of a manufacturing process where a first insulating member is disposed over a portion of the first switch contact.

With reference to FIG. 4, the first electrically insulating member 44 can be disposed over a portion of the base 40 and the first contact 42 and can cover the first bridge element 64. The first electrically insulating member 44 can be formed of any suitable insulating material and can have a thickness that is selected to provide a desired level of electric insulation. In the particular example provided, the first electrically insulating member 44 is formed of polyimide and has a thickness of about two microns. The first electrically insulating member 44 does not extend over the entirety of the first contact 42 and the base 40. The uncovered portion of the first contact 42 is configured to be coupled to an electric lead (e.g., wire or contact) that is electrically coupled to the safe-and-arm device 14 (FIG. 1).

Figure 5:
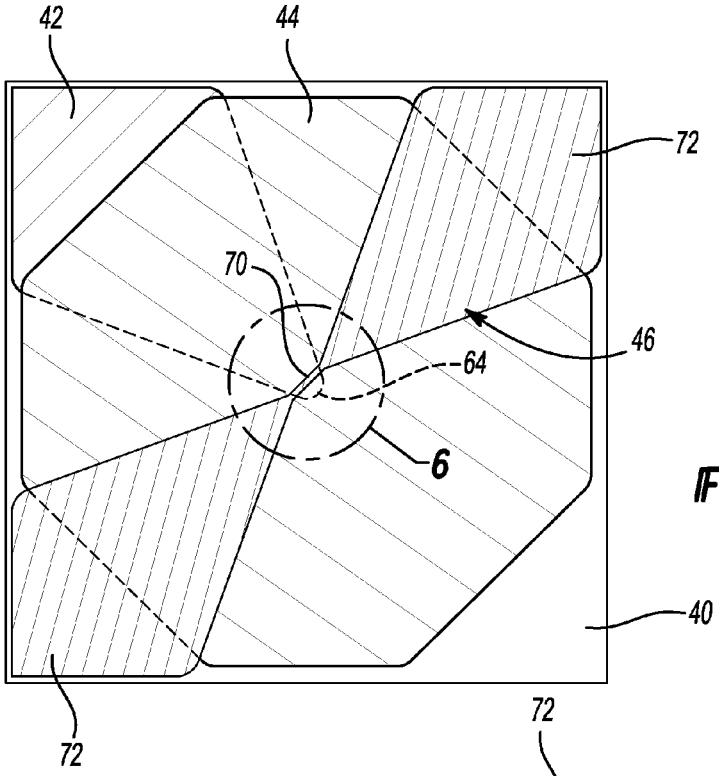
FIG. 5 is a top plan view of a portion of the initiator assembly depicting a portion of a manufacturing process where a second switch is disposed over a portion of the first insulating member.
Figure 6:
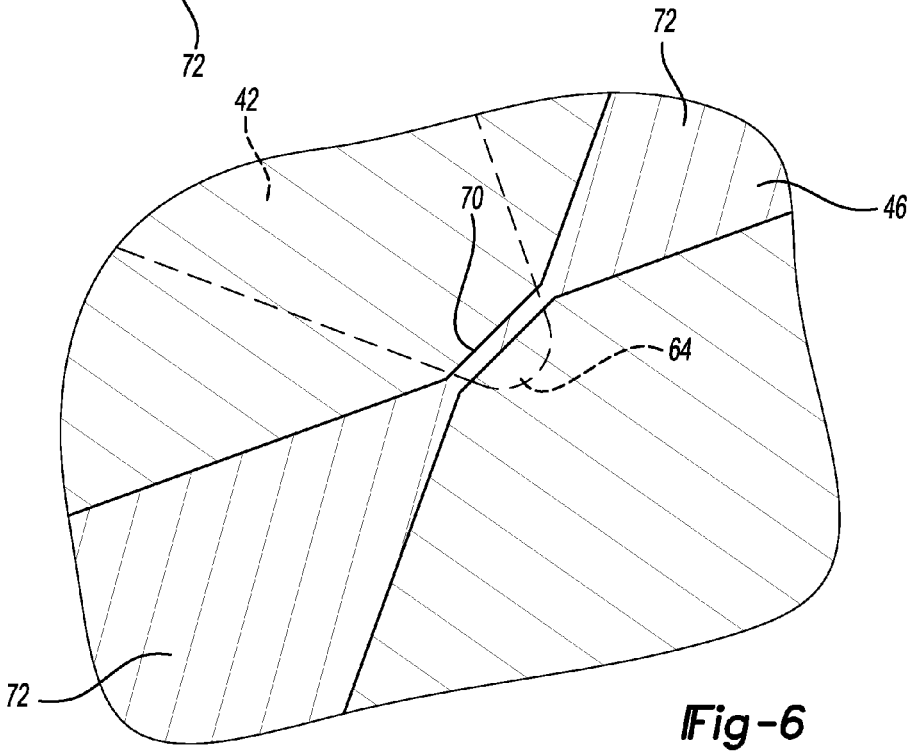
FIG. 6 is an enlarged portion of FIG. 5.

In FIGS. 5 and 6, the trigger switch 46 defines a switch element 70 and a pair of second switch contacts 72 that are disposed on opposite sides of the switch element 70. The switch element 70 can be disposed over the first bridge element 64 such that it is centered on a line that defines an end of the semi-circular shape of the tip of the first bridge element 64. The trigger switch 46 can be formed in a desired manner, such as vapor deposition, from one or more suitable electrically conductive materials, such as nickel, copper, gold, silver and alloys thereof, and can be layered over the base 40 and the first electrically insulating member 44. In the example provided, portions of the second switch contacts 72 are mounted directly to exposed portions of the planar surface 60 of the base 40, while the remaining portion of the trigger switch 46 is mounted to the first electrically insulating member 44 such that the first electrically insulating member 44 is disposed along the axis 66 between the first bridge element 64 of the first contact 42 and the trigger switch 46.

Figure 7:
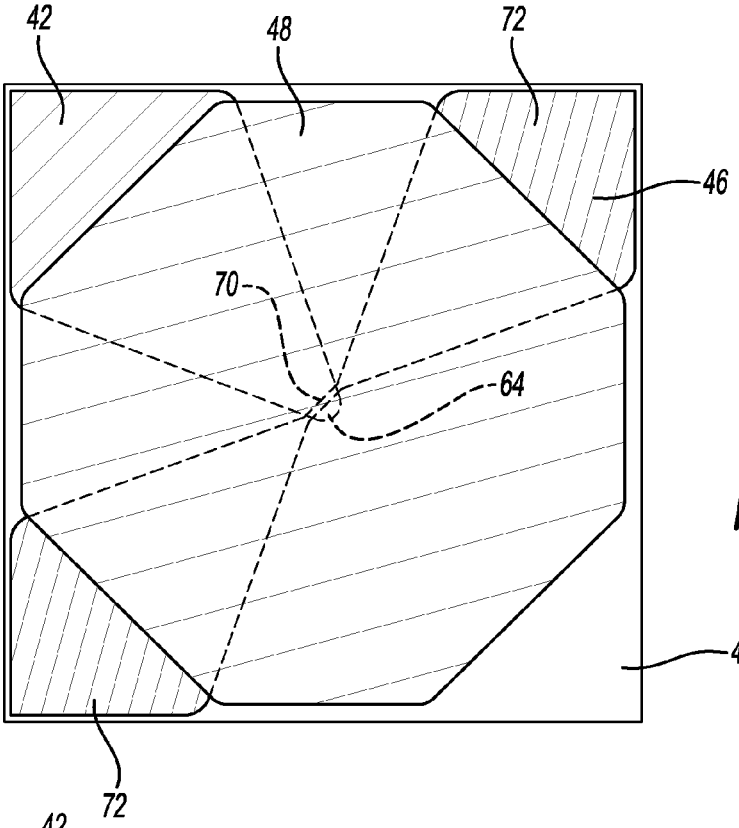
FIG. 7 is a top plan view of a portion of the initiator assembly depicting a portion of a manufacturing process where a second electrically insulating member is disposed over a portion of the second switch.

In FIG. 7, the second electrically insulating member 48 can be disposed over a portion of the trigger switch 46 and the first electrically insulating member 44. The second electrically insulating member 48 can be formed of any suitable insulating material and can have a thickness that is selected to provide a desired level of electric insulation. In the particular example provided, the second electrically insulating member 48 is formed of polyimide and has a thickness of about five microns. The second electrically insulating member 48 does not extend over the entirety of the second switch contacts 72 and the base 40. The uncovered portion of each of the second switch contacts 72 is configured to be coupled to an electric lead (e.g., wire or contact) that is electrically coupled to the safe-and-arm device 14 (FIG. 1).

It will be appreciated that the trigger switch 46 and the insulating material between the trigger switch 46 and the second bridge element 50 (i.e., the second electrically insulating member 48 in the particular example provided) are optional and may be omitted from a design in which the additional triggering capabilities provided by the trigger switch 46 are not desired. If the trigger switch 46 and the second electrically insulating member 48 are omitted, the initiator assembly can be operated by applying electrical power having a voltage that is sufficient by itself to penetrate through the insulating material that is disposed between the first contact 42 and the second bridge element 50.

Figure 8:
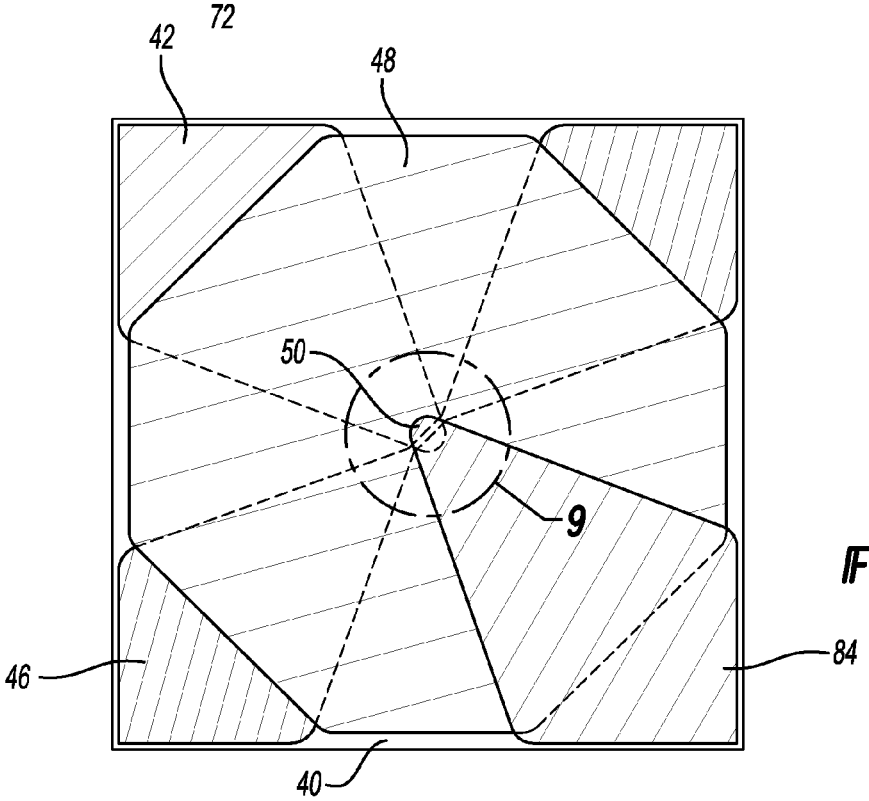
FIG. 8 is a top plan view of a portion of the initiator assembly depicting a portion of a manufacturing process where a bridge is disposed over a portion of the second insulating member.
Figure 9:
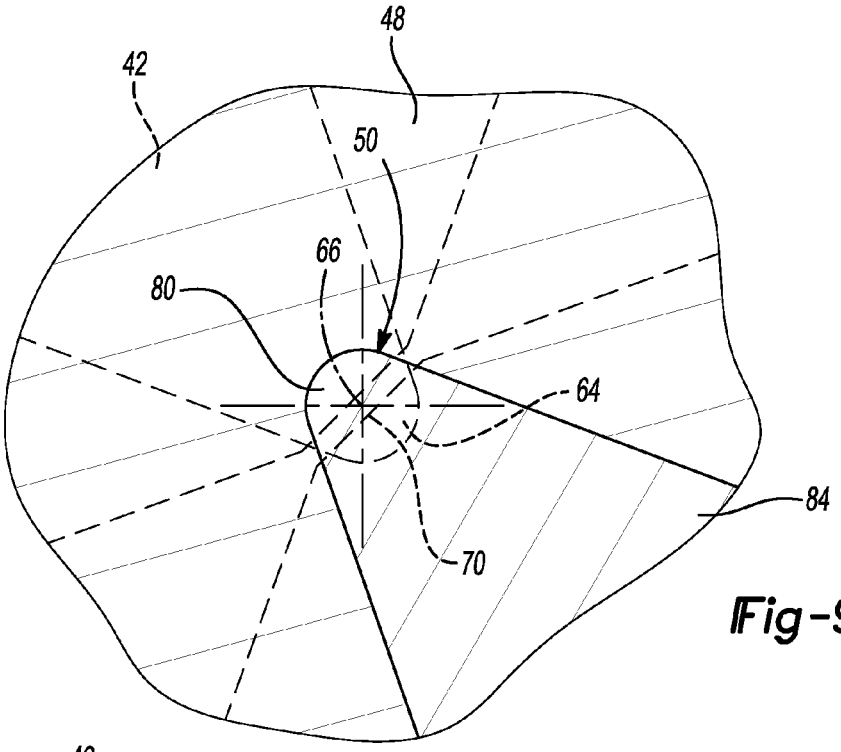
FIG. 9 is an enlarged portion of FIG. 8.

In FIGS. 8 and 9, the second bridge element 50 can be formed in a desired manner, such as by vapor deposition, from one or more suitable electrically conductive materials, such as nickel, copper, gold, silver and alloys thereof, and can be fixedly coupled to the second electrically insulating member 48 such that the second electrically insulating member 48 is disposed along the axis 66 between the switch element 70 and the second bridge element 50. The second bridge element 50 can have a semi-circular end 80 that can be defined by a radius that is centered on the axis 66. The semi-circular end 80 of the second bridge element 50 can overlap the first bridge element 64 of the first contact 42. More specifically, the semi-circular end 80 of the second bridge element 50 and the semi-circular segment of the tip of the first bridge element 64 can cooperate to define a circular area that is bounded by a circle. The second bridge element 50 can be electrically coupled to a bridge contact 84 that is mounted to the second electrically insulating member 48 and the base 40. The bridge contact 84 can be formed in a desired manner, such as by vapor deposition, from one or more suitable electrically conductive materials, such as nickel, copper, gold, silver and alloys thereof.

Figure 10:
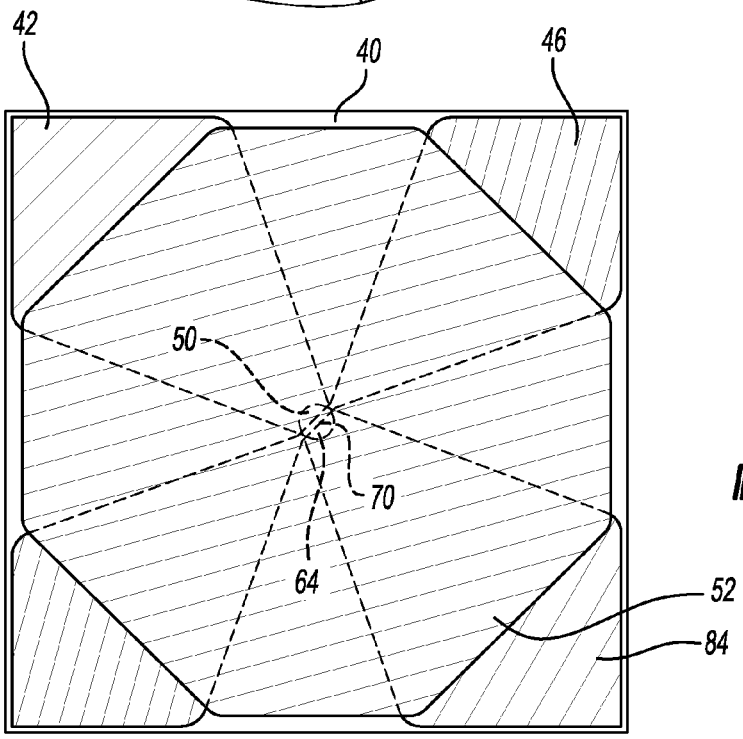
FIG. 10 is a top plan view of a portion of the initiator assembly depicting a portion of a manufacturing process where a third electrically insulating member is disposed over a portion of the bridge.

In FIG. 10, the third electrically insulating member 52 can be disposed over the second bridge element 50 and a portion of the bridge contact 84. The third electrically insulating member 52 can be formed of any suitable insulating material and can have a thickness that is selected to provide a desired level of electric insulation. In the particular example provided, the second electrically insulating member 48 is formed of polyimide and has a thickness of about three microns. The uncovered portion of the bridge contact 84 is configured to be coupled to an electric lead (e.g., wire or contact) that is electrically coupled to the safe-and-arm device 14 (FIG. 1).

Returning to FIG. 2, the flyer layer 22 and the barrel 24, which can both be formed of polyamide, can be mounted to the initiator device 20 such that the barrel aperture 28 is centered about the axis 66. Optionally, the flyer layer 22 can be the third electrically insulating member 52.

The input charge 26 could be formed of any desired energetic material, such as a primary or secondary explosive. Suitable secondary explosives include RSI-007, which is available from Reynolds Systems, Inc. of Middletown, Calif., and hexanitrostilbene (HNS). The input charge 26 can be positioned relative to the barrel 24 to receive impact energy from the flyer 22*a* when the initiator assembly 10 is operated.

With reference to FIGS. 1, 2 and 8, when the initiator assembly 10 is to be operated, electric energy can be provided by the safe-and-arm device 14 and can be applied to the first contact 42 and the bridge contact 84, and optionally to the second switch contacts 72 with current and voltage that is necessary to vaporize the first and second bridge elements 64 and 50, and optionally the switch element 70. Vaporization of the switch element 70 can be configured to damage or degrade the first and second electrically insulating members 44 and 48 in an area that is vertically between the first bridge element 64 and the second bridge element 50, which reduces the electric potential that would otherwise be needed to transmit electric energy from the first bridge element 64 of the first contact 42 through the first and second electrically insulating members 44 and 48 to the second bridge element 50 to vaporize the first and second bridge elements 64 and 50. Vaporization of the first and second bridge elements 64 and 50 applies a force to the flyer layer 22 that causes a portion of the flyer layer 22 (i.e., the flyer 22*a*) to shear from the remainder of the flyer layer 22 and travel through the barrel aperture 28 where it impacts a structure, such as the input charge 26.

Figure 11:
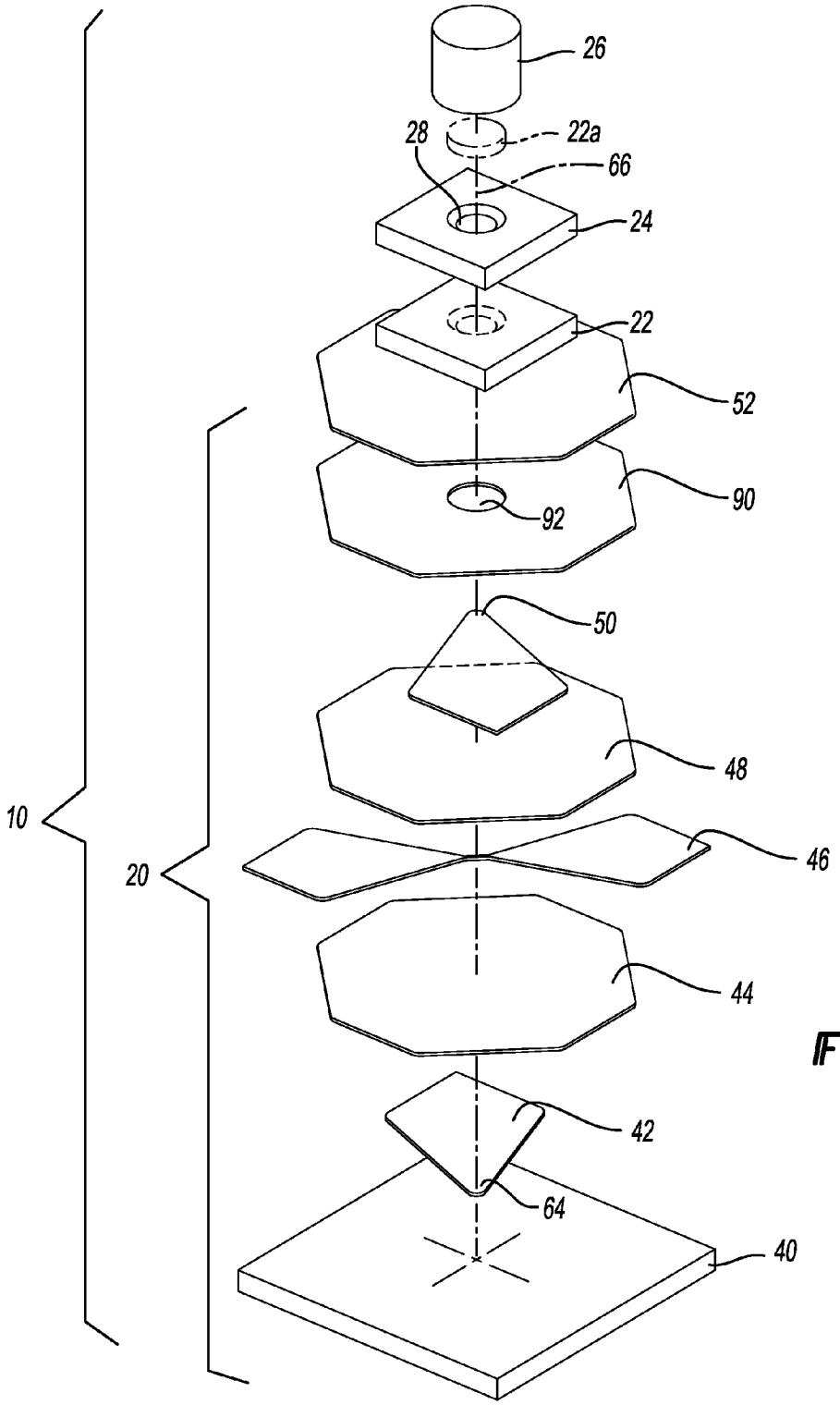
FIG. 11 is a view similar to that of FIG. 2 but depicting an alternately constructed initiator assembly.

In FIG. 11, another insulating member 90 can be disposed between the second bridge element 50 and the third electrically insulating member 52. This additional insulating member 90 can define an aperture 92 that can be centered on the first and second bridge elements 64 and 50 and can be sized so as to not interfere with the breakdown (i.e., transmission of electrical energy) between the first and second bridge elements 64 and 50. The additional insulating member can increase the dielectric strength everywhere except in a zone where the first and second bridge elements 64 and 50 overlap one another along the axis 66. This has the effect of forcing the breakdown to occur in a desired location and reduces the area over which extreme visual inspection (to identify defects in the dielectric materials) is needed. Given the difficulty in positioning the various elements in an exact alignment, we contemplate that the circle that is defined by the tip of the first bridge element 64 and the end of the second bridge element 50 can be about 0.0080 to about 0.0090 inch in diameter, while the aperture 92 in the additional insulating member 90 can be about 0.0060 to about 0.0070 inch in diameter.

From the foregoing description, those of skill in the art will appreciate that switching capabilities can be integrated into a LEEFI in a manner that directs the discharge of electrical energy from a switch device into the LEEFI in a vertical direction so that the area or "foot print" of the LEEFI is not increased relative to the area or foot-print of a LEEFI that does not have switch capabilities.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An initiator assembly comprising:

a base;

a first contact coupled to the base, the first contact defining a first bridge element;

a first electrically insulating member disposed over the first bridge element such that the first bridge element is disposed along an axis between the base and the first electrically insulating member;

a second bridge element coupled to the first electrically insulating member such that the first electrically insulating member is disposed along the axis between the first bridge element and the second bridge element;

a flyer layer coupled to the second bridge element;

a barrel coupled to the base and disposed over the second bridge element and at least a portion of the flyer layer, the barrel being disposed along the axis; and an energetic material disposed along the axis, the energetic material being positioned so as to receive energy from a flyer formed from the flyer layer when the initiator assembly is operated to vaporize the first and second bridge elements via transmission of electrical energy through the first electrically insulating member.

2. The initiator assembly of claim 1, wherein the energetic material is a secondary explosive.

3. The initiator assembly of claim 1, wherein the second bridge element has a semi-circular end that overlaps an end of the first bridge element.

4. The initiator assembly of claim 3, wherein the first bridge element has a semi-circular tip is disposed under the second bridge element.

5. The initiator assembly of claim 4, wherein an edge of the semi-circular end of the second bridge element and an edge of the semi-circular tip of the first bridge element cooperate to form a circle.

6. The initiator assembly of claim 1, wherein a trigger element and a second electrically insulating member are received between the first electrically insulating member and the second bridge element, the trigger element being disposed along the axis between the first and second electrically insulating members and being disposed along the axis.

7. The initiator assembly of claim 6, wherein the second bridge element has a first area and wherein a portion of the trigger element that is in-line with the second bridge element along the axis has a second area and wherein the second area is less than ten percent of the first area.

8. A method comprising:

providing an initiator assembly having a first bridge element, a second bridge element, a flyer layer, a barrel and an energetic material, the first bridge element and the second bridge element being spaced vertically apart along an axis, the flyer layer overlying the second bridge element, the barrel defining a barrel aperture and being disposed over at least a portion of the flyer layer, the energetic material being disposed along the axis and positioned on a side of the barrel opposite the flyer layer; and applying electrical power to the first bridge element to vaporize the first and second bridge elements, wherein electrical power applied to the first bridge element is transmitted through an electrically insulating material that is disposed between the first and second bridge elements along the vertical axis, wherein vaporization of the first and second bridge elements causes a portion of the flyer layer within the barrel aperture to be expelled from the barrel.

9. The method of claim 8, wherein the initiator assembly further comprises first and second electrically insulating members and a trigger element that is disposed between the first and second electrically insulating members, and wherein the method further comprises operating the trigger element.

10. The method of claim 9, wherein operation of the trigger element damages the first and second electrically insulating members.

11. The method of claim 9, wherein operation of the trigger element reduces or eliminates the electrical insulation between the first and second bridge elements that is otherwise provided by the first and second electrically insulating members.

12. An initiator assembly comprising:

a base;

a first conductive element coupled to the base, the first conductive element including a first bridge element and being configured to receive an electrical input;

a first electrically insulating member disposed over the first bridge element;

a second conductive element having a second bridge element that is disposed over the first electrically insulating member, the second bridge element being configured to vaporize with the first bridge element in response to transmission of the electrical input from the first bridge element to the second bridge element; and an energetic material disposed over the second bridge element;

wherein energy produced during vaporization of the first and second bridge elements is transmitted to the energetic material to initiate at least one of a combustion event, a deflagration event and a detonation event in the energetic material.

13. The initiator assembly of claim 12, wherein the energetic material is a secondary explosive.

14. The initiator assembly of claim 12, wherein the second bridge element has a semi-circular end that overlaps the first bridge element.

15. The initiator assembly of claim 14, wherein the first bridge element ends in a semi-circular segment that is disposed under the second bridge element.

16. The initiator assembly of claim 15, wherein the semi-circular end of the second bridge element and the semi-circular segment of the first bridge element cooperate to define a circular area.

17. The initiator assembly of claim 12, wherein a trigger element and a second electrically insulating member are received between the first electrically insulating member and the second bridge element, the trigger element being disposed in-line with the first bridge element and the second bridge element and between the first and second electrically insulating members.

18. The initiator assembly of claim 17, wherein the second bridge element has a first area and wherein a portion of the trigger element that is in-line with the second bridge element has a second area and wherein the second area is less than ten percent of the first area.

19. The initiator assembly of claim 17, wherein the second bridge element is electrically coupled to a second conductive element, wherein the trigger element is electrically coupled to a pair of switch contacts, and wherein portions of each of the first and second conductive elements and the switch contacts are mounted directly to the base.

* * * * *